US005155883A

United States Patent [19]

Legault

[11] Patent Number: 5,155,883

[45] Date of Patent: Oct. 20, 1992

[54] COMBINATION GOLF CLUB CLEANER AND BALL WASHER

[76] Inventor: Raymond L. Legault, 41 Admiral Ct., Palm Beach Gardens, Fla. 33418

[21] Appl. No.: 496,589

[22] Filed: Mar. 21, 1990

[51] Int. Cl.[5] ..... A63B 47/04; A46B 13/08

[52] U.S. Cl. ..... 15/21.2; 15/88.4

[58] Field of Search ..... 15/88.3, 88.4, 39, 21.2; 220/331

[56] References Cited

U.S. PATENT DOCUMENTS

| | | | |
|---|---|---|---|
| 705,672 | 7/1902 | Hughes | 220/331 |
| 1,780,850 | 11/1930 | Strong | 15/21.2 |
| 1,954,738 | 2/1933 | Lerch | 15/21.2 |
| 2,005,115 | 6/1935 | Stutz | 15/21.2 |
| 2,072,022 | 2/1937 | Bristow | 15/21.2 X |
| 2,617,132 | 11/1952 | Goller | 15/21.2 |
| 3,148,396 | 9/1964 | Smith | 15/88.3 |
| 3,748,676 | 7/1973 | Warren et al. | 15/21.2 |
| 4,958,396 | 9/1990 | Butler et al. | 15/88.4 X |
| 4,965,906 | 10/1990 | Mauro | 15/21.2 X |

FOREIGN PATENT DOCUMENTS

| | | | |
|---|---|---|---|
| 0521032 | 7/1976 | U.S.S.R. | 15/88.3 |
| 0290641 | 8/1928 | United Kingdom | 15/39 |

*Primary Examiner*—Paul T. Sewell
*Assistant Examiner*—Ted Kavanaugh
*Attorney, Agent, or Firm*—Salter & Michaelson

[57] ABSTRACT

A device for selectively cleaning the head of a golf club or for cleaning the surface of a golf ball, including a housing having a cleaning chamber formed therein, a pair of brush members being mounted in the housing for counterrotation, each of the brush members being mounted on separate shafts that are disposed in the housing in spaced parallel relation so that the bristles of the brush members are disposed in overlapping relation with respect to each other, the head of a golf club being insertable into the chamber for location of the face of the club in engaging relation with the bristles of the brush members, the chamber having a liquid contained therein and the counterrotating movement of the brush members creating movement of the liquid in the chamber between the brush members, wherein the movement of the liquid cooperates with the movement of the brush members to effectively clean the club head as disposed therebetween, and a top member having a ball receiving tube joined thereto, the top member being removably mounted on the housing and receiving a ball therein for engagement with the bristles of the brush members, and means for rotating the brush members to selectively clean either the face of the club in engagement therewith or the surface of the ball as disposed in engaging relation therewith.

6 Claims, 4 Drawing Sheets

COMBINATION GOLF CLUB CLEANER AND BALL WASHER

BACKGROUND OF THE INVENTION

The present invention relates to a device for selectively cleaning the head of a golf club or for cleaning the surface of a golf ball and is intended for use either at a fixed location on a pedestal or other horizontal member, or for mounting on a vertical wall, or in the alternative may also be mounted on a golf cart for immediate access regardless of the location of the cart as it is moved around a golf course.

Prior to the instant invention, golf clubs have normally been cleaned by using a hand brush or wet rag and a bucket of water, wherein the face of the club is hand cleaned by a few cursory wiping motions of the brush or cloth along the face of the club. This rather rudimentary style of cleaning the face of a club has never been satisfactorily accepted, since bag room personnel are usually to busy in their normal activities to devote the time and effort that is required for hand cleaning the clubs prior to the removal of a player's golf bag from a cart or caddy for transfer to the storage area of a bag room. In such circumstances, it has often been the experience of players to find that when they reuse their clubs in the next round, the clubs are usually dirty, and the grooves in the club irons are filled with dirt and the club heads are generally messy in appearance. If a player cleans his own clubs, he generally does not have access to cleaning implements on the golf course or around a club house, and usually forgets to clean the clubs when they are stored at home or in the trunk of a car.

In some instances, golf club cleaning devices have been installed in and around bag storage areas, but even these prior known devices have been unacceptable, since they have not been found to satisfactorily remove the dirt and grime that adhere in the grooves of the club irons. Even the woods through constant usage become effaced with dirt, and the technique used to clean both the irons and woods by the prior known cleaning devices have just not been satisfactory.

Some examples of the prior known cleaning devices as represented by prior issued patents are illustrated in the U.S. Pat. Nos. to Hoag U.S. Pat. No. 3,872,534; Kinsey, U.S. Pat. No. 4,472,851; Wyckoff et al, U.S. Pat. No. 4,821,358; Parchment et al, U.S. Pat. No. 4,734,952; and Caradonna, U.S. Pat. No. 4,380,839. The Hoag patent which discloses a golf club head washer having a motor driven brush assembly located in a cleaning chamber may be effective in use, but because of the bulk and complicated structure of this device, it is not practical for use away from a bag room area, and is certainly not economically available for use by the individual golfer. The patent to Kinsey which is water driven needs a supply of water for the operation thereof and for this reason has limited application and actually does not include the type of brush element that would satisfactorily clean a club head. The patents to Wyckoff et al, Parchment et al, and Caradonna are those type of devices that may be portable in operation and could even be found in various areas of a golf course, but require the vertical movement of the golf club between the adjacent brushes as incorporated in these devices. For all of these reasons, the patented devices are not acceptable as effective cleaning aids for golf clubs and further, are not universal in use in that they cannot also function to clean the face of a wood golf club.

It is further contemplated that the subject invention be usable as a ball washing device, and in this connection utilizes the brush members as located in a housing to effectively clean a ball upon movement of the brushes. Golf ball washing devices are generally known and examples of such devices are illustrated in the U.S. Pat Nos. to Day, U.S. Pat. No. 784,662; Strong, U.S. Pat. No. 1,780,850; Signorini, U.S. Pat. No. 1,862,437; King, U.S. Pat. No. 1,469,274; Haskins, U.S. Pat. No. 2,195,303; and Benkovsky, U.S. Pat. No. 4,381,574. All of these aforesaid listed U.S. patents are directed specifically to devices for cleaning golf balls and incorporate some kind of cleaning implement such as brushes that are rotated to effect the cleaning of the surface of a golf ball that is placed in contact therewith. None of these prior known devices show or illustrate a combination unit as developed by the applicant herein, and further do not disclose or show the specific manner in which the subject invention provides for the cleaning of the surface of a ball that is placed in contact with the brush elements that are disposed in the housing of the subject invention.

SUMMARY OF THE INVENTION

The present invention relates to a device for selectively cleaning the head of a golf club that has a face in which a plurality of parallel grooves are formed or for cleaning the surface of a golf ball and includes a housing defined by a plurality of walls. Spaced side walls of the housing are joined to front and back walls, and a bottom wall to which the front, back and side walls are joined cooperate therewith to define an interior chamber therebetween. A pair of brush members, each of which includes a central shaft that is mounted for rotation between an opposed pair of said walls locates the brush members for rotation within the chamber. The shafts are interconnected for counterrotation with respect to each other, each of the brush members including bristles that radiate outwardly relative thereto, the shafts being disposed in spaced parallel relation so as to locate the bristles of the brush members in overlapping relation with respect to each other. Means are joined to one of the shafts to provide for rotation of the interconnected shafts and their respective brush members, the head of the golf club being insertable into the chamber for location of the face of the club in engaging relation with the bristles of the brush members, wherein the grooves as formed in the face of the club are disposed in substantially a vertical direction, which enables the brushes of one of the brush members to extend therein during the cleaning operation. The chamber has a liquid contained therein, the counterrotating movement of the brush members creating movement of the liquid in the chamber between the brush members, wherein the movement of the liquid cooperates with the movement of the brush members to effectively clean the club head as disposed therebetween.

Accordingly, it is an object of the subject invention to provide a device for cleaning the head of a golf club that has a face in which a plurality of parallel grooves are formed or for cleaning the surface of a golf ball, and includes a housing in which brush members are mounted for counterrotation, the brush members receiving the head of a club therebetween for cleaning the grooves therein and other surfaces in contact therewith, the housing further including means for receiving a golf ball for engagement with the brushes, whereby the ball is effectively cleaned as the brush members are rotated in counterrotation with respect to each other.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
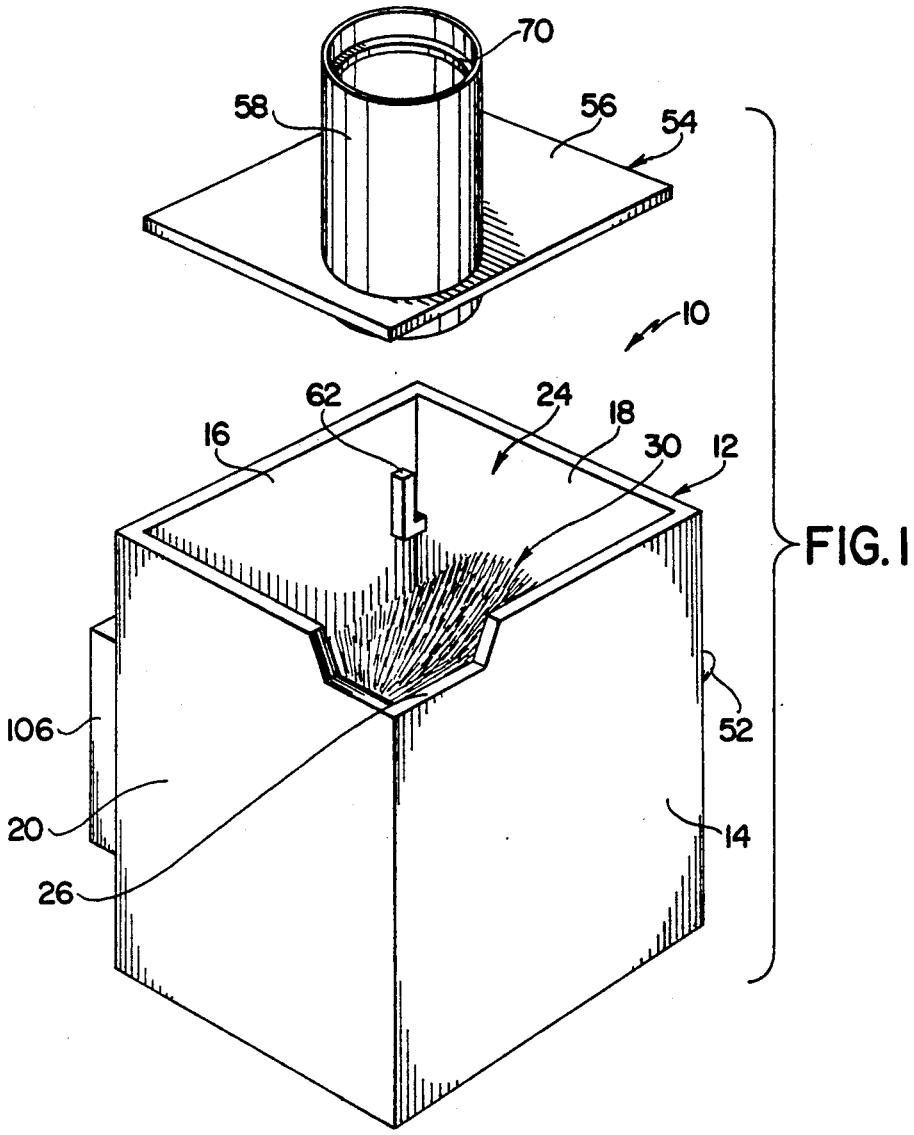
FIG. 1 is a perspective exploded view of the cleaning device as embodied in the subject invention, and illustrates the housing of the device and further shows a top ball receiving member used for cleaning a golf ball by the device.
Figure 2:
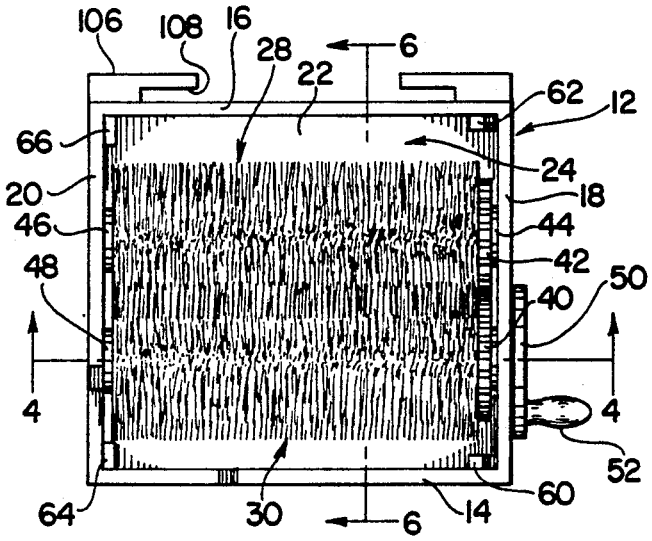
FIG. 2 is a top plan view of the housing illustrating brush members therein.

Referring to the drawings and particularly to FIGS. 1 and 2, the cleaning device embodied in the subject invention is illustrated and is generally indicated at 10. The cleaning device 10 includes a housing generally indicated at 12 that is defined by a front wall 14, a rear wall 16, side walls 18 and 20, and a bottom wall 22. The walls 14–22 are all preferably formed of a suitable rigid plastic material and are joined together by any suitable means to define an interior chamber generally indicated at 24. Formed in the upper portions of the adjacent walls 14 and 20 is a notched out portion 26 which is designed to receive the shaft of a club to be cleaned as will hereinafter be described.

Figure 6:
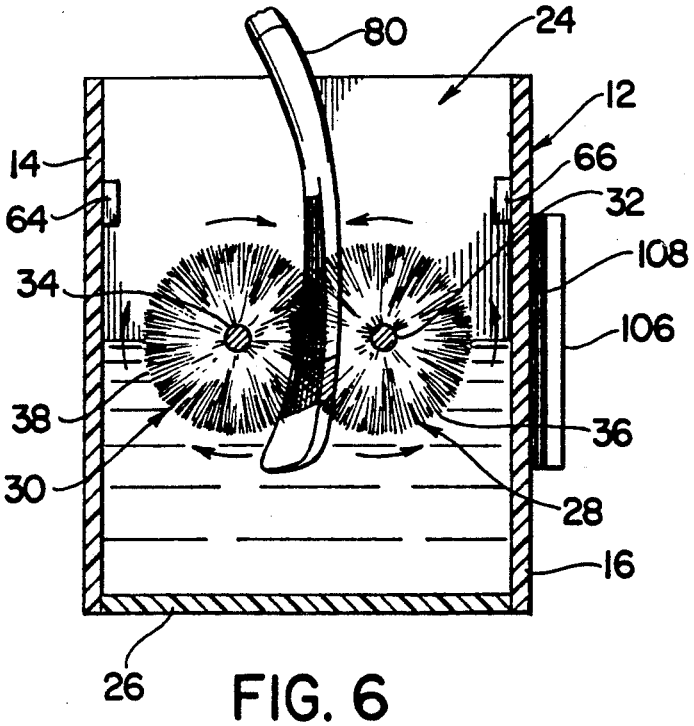
FIG. 6 is a sectional view taken along line 6—6 in FIG. 4.

Mounted interiorly of the chamber 24 for counterrotation with respect to each other are brush members generally indicated at 28 and 30. As shown in FIG. 6, the brush members include parallel extending shafts 32 and 34 on which are fixed a first set of outwardly extending bristles 36 that are secured to the shaft 32 and a second set of outwardly extending bristles 38 that are secured to the shaft 34. The shafts 32 and 34 are located such that the adjacent portions of the bristles 36 and 38 overlap in an area between the shafts so as to promote a thorough cleaning action of a club head that is inserted therebetween.

Referring now to FIG. 2, the brush members 28 and 30 as mounted between the walls 18 and 20 are shown having corresponding spur gears 40 and 42 attached thereto adjacent to the wall 18. The ends of the shaft 32 are disposed in bearing members 44 and 46 which are mounted interiorly of the walls 18 and 20, respectively, the bearing members providing for smooth rotation of the brush member 28. One end of the shaft 34 is also mounted in a bearing member 48 that is fixed to the interior surface of the wall 20, while the opposite end of the shaft 34 extends through a suitable "O" ring sealing member 43 as formed in an opening in the wall 18 for securement to a handle member 50 to which a handle portion 52 is joined. Rotation of the handle member 50 rotates the gear 40 and the gear 42 joined thereto for the rotary movement of the brush members 28 and 30 in counterrotation with respect to each other. In order to promote an effective cleaning action of a golf club head, the chamber 24 is provided with a cleaning liquid therein, although it is understood that water with a detergent or similar cleaning compound may be introduced into the chamber, and will still cooperate with the brush members to produce an effective cleaning action.

Figure 3:
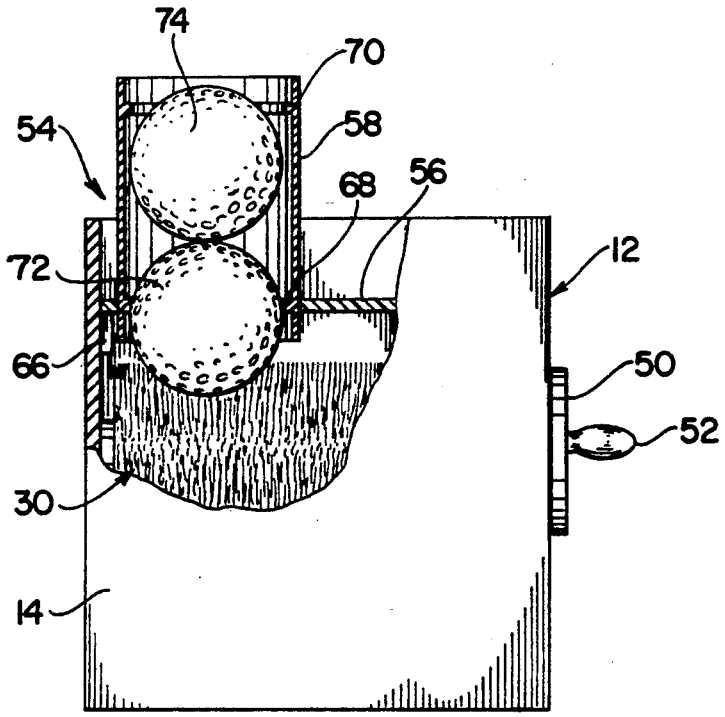
FIG. 3 is a side elevational view of the housing, the top member being mounted in position thereon, and portions being broken away to illustrate the position of a golf ball during the cleaning operation thereof.
Figure 7:
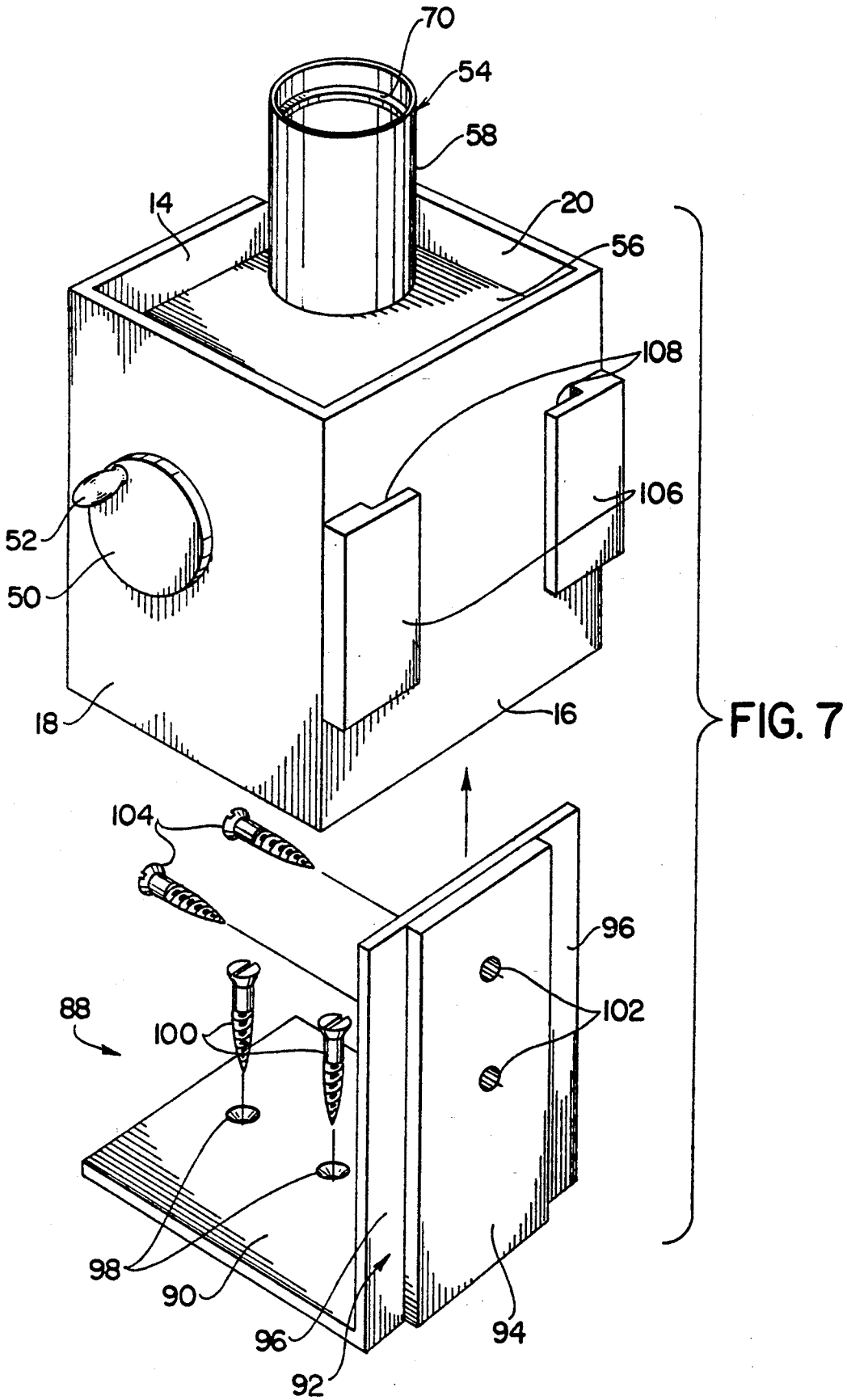
FIG. 7 is an exploded perspective view showing a mounting device for receiving the cleaning device thereon when the device is mounted in place on a fixed support.

Referring now to FIGS. 1, 3 and 7, a top member generally indicated at 54 is illustrated and is receivable within the walls of the housing 12 when a ball washing operation is to take place or for enclosing the interior chamber 24 of the housing. The top member 54 includes a top plate 56 having an opening formed therein in which a tubular member 58 is received, the tubular member extending inwardly of the plate 56 for a short distance therebeyond. In the placement of the top member 54 within the housing 12, and for the support thereof in the position as illustrated in FIG. 7, support elements are fixed to the interior surfaces of the walls for locating the top member 54 within the housing 12 in a horizontal support position. In this connection, a first set of support elements 60 and 62 are joined to the walls 14 and 16, respectively, the supports 60 and 62 being spaced downwardly from the top edges of the housing and also being spaced outwardly from the wall 18 for the purpose to be described hereinafter. A second set of support elements 64 and 66 are fixed to the wall 20 and spaced downwardly from the top edges of the walls 14, 16 and 20 to correspond to the position of the support elements 60 and 62. Thus, when the top member 54 is inserted within the walls of the housing, the corresponding edges of the top plate 56 rests on the support elements for retaining the top member 54 in a supported position as shown in FIG. 7. In this position, as shown in FIG. 3, the lowermost edge of the tubular member 58 extends just above the brush members so that a ball received therein is held in a surface engaging position with respect to the brush members.

As further illustrated in FIG. 3, the interior surface of the tubular member 58 is provided with an inwardly projecting lower annular ring 68 and an inwardly projecting upper annular ring 70. The annular rings 68 and 70 are dimensioned for receiving a golf ball having a prescribed diameter so that the annular rings in effect define measuring devices to determine whether a golf ball inserted into the tubular member is in perfect round. A ball indicated at 72 in FIG. 3 has been inserted into the tubular member and beyond the ring 68 for engagement with the brush members, a second ball 74 having also been inserted beyond the upper annular ring 70 for engagement with the ball 72. As will hereinafter be described, pressure exerted on the upper ball 74 will urge the lower ball 72 to be cleaned in engagement with the brush members 28 and 30 for the cleaning thereof.

Figure 4:
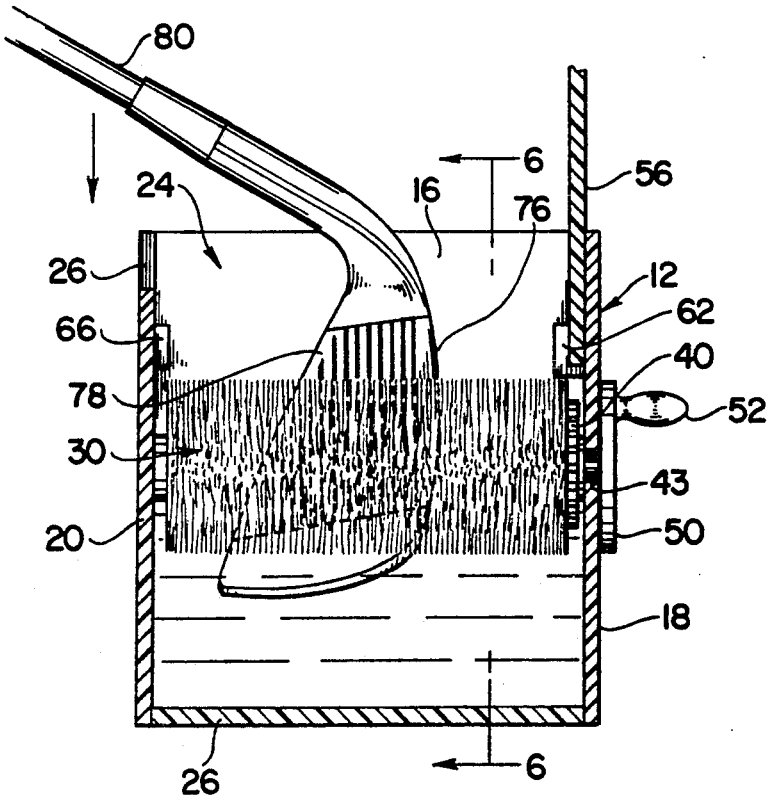
FIG. 4 is a sectional view taken along line 4—4 in FIG. 2 showing the position of a golf club iron as disposed between the brushes in the housing during a cleaning operation.

Prior to use of the device in a cleaning operation, the top member 54 is removed from the closed position as shown in FIG. 3 to an open position as shown in FIG. 4. In order to provide for storage of the top member 54 within the housing 12, the support elements 60 and 62 are provided and as shown in FIGS. 1, 2, 4 and 5 are spaced from the adjacent wall 18 so as to define a space therebetween for receiving the top plate 56 therein. As more clearly illustrated in FIGS. 4 and 5, the top member 54 is disposed in a generally vertical position as located in the spaces defined by the supports 60 and 62 and the adjacent wall 18, thereby exposing the interior chamber 24 during a club head cleaning operation.

In use of the device for cleaning the face of a iron club head, an iron club head indicated at 76 in FIG. 4 is inserted into the open chamber 24, parallel grooves indicated at 78 in the club head being disposed in a generally vertical direction. The user of the device then rotates the handle 50 by means of the handle element 52 for causing the brush members 28 and 30 to rotate in a counterrotating direction as illustrated in FIG. 6. The counterrotating movement of the brush members as indicated by the arrows in FIG. 6 produces a downflow of the cleaning liquid and also causes the bristles 38 of brush member 30 to penetrate into the parallel groove 78 of the club head 76. As the brush members are rotated by the handle 50, the brush member 28 engages the rear surface of the club head 76 and produces the cleaning action simultaneously with the cleaning action of the brush member 30. Further, as the user moves the shaft 80 of the club 76 in a vertical direction, as seen in FIG. 4, the shaft 80 is directed into the groove 26 which allows for an additional descending movement of the club head 76 within the chamber 24, thereby enabling the bristles 38 of the brush member 30 to penetrate the full extent of the parallel grooves 78 of the club head. The cleaning operation actually is accomplished in a matter of seconds as the club head is moved up and down vertically within the chamber 24 as the brush members 28 and 30 are rotated. By utilizing a cleaning fluid such as water or other liquid introduced into the cleaning chamber 24 as the brush members 28 and 30 are rotated, the swirling effect of the liquid is created in a counterrotating movement which lends itself to a more thorough scrubbing action of the club head. Thus, as the brush members 28 and 30 and cleaning liquid engage the surfaces of the club head, debris and dirt as removed from the club head are directed downwardly into the bottom of the chamber 24. It is therefore seen that the brush members cooperate with the cleaning liquid in the chamber 24 to thoroughly clean the club head in a relatively short period of time.

Figure 5:
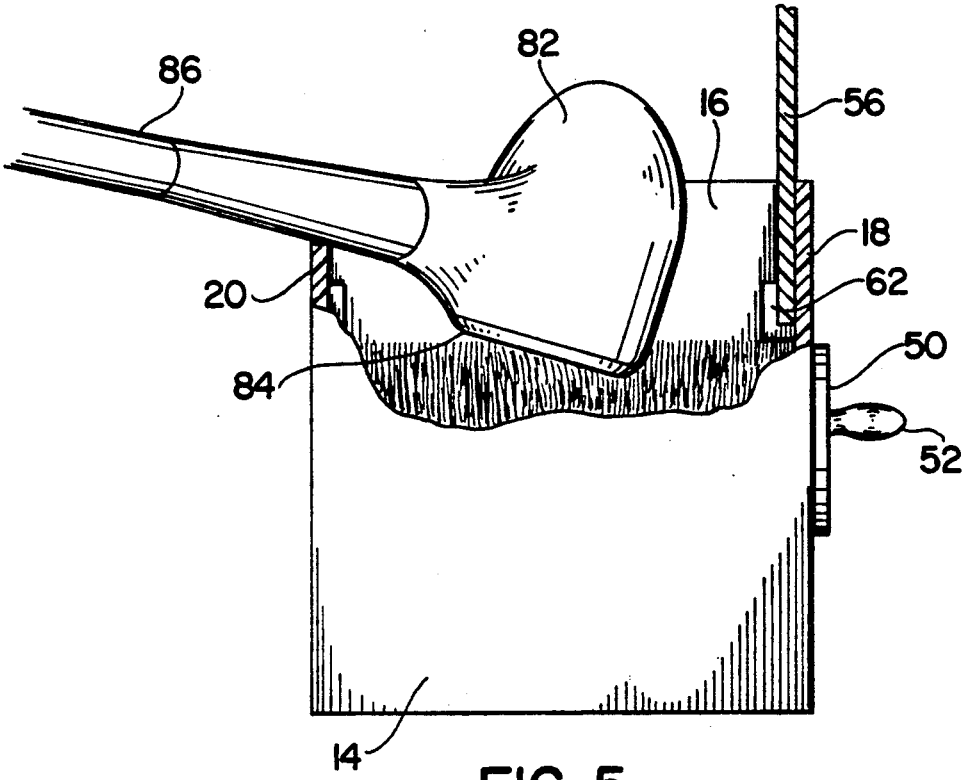
FIG. 5 is a side elevational view of the housing with a portion broken away to show the position of the head of a wood golf club during the cleaning operation.

Although the cleaning device of the subject invention has particular application in cleaning irons, it is also adaptable for cleaning the faces of wood clubs as indicated in FIG. 5. In this connection, a wood head indicated at 82 in FIG. 5 is located within the chamber 24, with the face of the club, indicated at 84, engaging the adjacent brush members 28 and 30. A shaft 86 of the wood club head 82 is received within the cut out portion 26 which enables the face 84 of the club head to be located substantially parallel with the brush members during the cleaning operation. Again, the brush members 28 and 30 are rotated by the handle 50 to produce a thorough scrubbing action, the liquid within the chamber 24 cooperating with the brush members 28 and 30 to produce an effective cleaning of the face of the wood club head and the grooves formed therein.

As described above, the subject invention is also designed to effectively clean golf balls, and for this purpose the top plate 54 and tubular member 58 fixed therein are provided. In order to effectively clean a golf ball, the top member 54 is located on the support elements 60, 62 and 64, 66 in a horizontal position. The ball 72 to be cleaned is inserted into the tube 58 and through the rings 68 and 70. The rings as described above also act to check the ball for roundness as it is moved therethrough. If for any reason the ball is out of round it will not pass through the rings 68 and 70 and can then be rejected. However, assuming that the ball 72 as illustrated in FIG. 3 is perfectly round, it will fit through the rings 68 and 70 and will engage the tops of the brush members 28 and 30. The second ball 74 is inserted into the tubular member 58 for engagement with the top of the ball 72. Pressure is exerted by the user on the top ball 74 which urges the ball 72 to be cleaned into firm contact with the brush members. Rotation of the brush members by the handle 50 will then produce a cleaning action as the ball is rotated as the brush members are moved thereagainst. The action of the bristles of the brush members engaging the ball 72 and the swirling action of the liquid in contact with the ball member upon rotation of the brushes will effectively clean the ball. The ball 72, after the cleaning action, is easily removed from the tubular member 58 upon lifting of the top member 54 from its seated position.

It is understood that the device 10 can be mounted on a suitable vertical post in a permanent location, and in this instance, a drain port would be provided in the bottom wall of the housing 12 for draining the cleaning fluid therefrom as required. In the preferred form of the invention, the device 10 is removably mounted on a vertical wall or on a horizontal platform such as on a flat surface of a golf cart, and for this purpose a bracket assembly generally indicated at 88 is provided as illustrated in FIG. 7. The bracket assembly 88 includes a horizontal plate 90 to which a vertical plate 92 is joined. Joined to the vertical plate 92 is a central plate 94 that has a horizontal dimension less than that of the plate 92 to expose vertical surfaces 96 of the plate 92. Formed in the horizontal plate 90 are countersunk openings 98 through which fastening screws 100 extend for mounting the bracket assembly 88 on a horizontal surface. In the event that the device is mounted on a wall, the vertical plate 92 is provided with countersunk openings 102 for receiving fastening screws 104 therethrough. In order to mount the housing 12 on the bracket assembly 88, spaced mounting brackets 106 are joined to the wall 16 of the housing, the mounting brackets 106 being formed with elongated slots 108 that receive therein the portion of the plate 92 that includes the surfaces 96. The central plate 94 of the vertical plate 92 slides between the brackets 96, the brackets 96 acting to firmly retain the housing 12 on the mounting assembly 88. Thus, regardless of the surface on which the mounting assembly 88 is secured, the housing 12 is positively fixed in position thereon for use as desired. The housing 12 is also easily removed from its mounted position to empty and replace the cleaning fluid in the interior chamber 24.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A device for selectively cleaning the head of a golf club that has a face in which a plurality of parallel grooves are formed and for cleaning the surface of a golf ball, comprising a housing defined by a front wall and a back wall spaced from said front wall in parallel relation with respect thereto, spaced side walls joined to said front and back walls, a bottom wall to which said front, back and side walls are joined and a removable top member that is mountable within said front, back and side walls in a horizontal covering position, means joined to said housing for receiving said top member in a storage position during a club cleaning operation, wherein said chamber is exposed for placement of the club head therein, said walls defining a cleaning chamber therebetween, a pair of brush members, each of which includes a central shaft that is mounted for rotation between an opposed pair of said walls for locating said brush members for rotation within said chamber, said shafts being interconnected for counterrotation with respect to each other, each of said brush members including bristles that radiate outwardly relative thereto, said shafts being disposed in spaced parallel relation so as to locate the bristles of said brush members in overlapping relation with respect to each other, means joined to one of said shafts to provide for rotation of the interconnected shafts and their respective brush members, the head of said golf club being insertable into said chamber for location of the face of said club in engaging relation with the bristles of one of said brush members, wherein the grooves as formed in the face of the club are disposed in substantially a vertical direction which enables the bristles of said one of said brush members to extend therein during the cleaning operation, said chamber having a liquid contained therein, the counterrotation movement of said brush member creating movement of the liquid in said chamber between said brush members wherein the movement of the liquid cooperates with the movement of said brush members to effectively clean the club head as disposed therebetween, said removable top member having an opening formed therein, a tubular member being secured in said opening, and being disposed in vertically spaced relation with respect to said brush members when said top member is located in the horizontal covering position, the diameter of said opening being dimensioned for slidably receiving a golf ball therein, means for retaining the ball as located in said tubular member in engaging relation with the bristles of said brush members as said brush members are rotated, wherein a cleaning action of said ball is effected.

2. A device as claimed in claim 1, said means joined to said one of said shafts including a handle that is located exteriorly of said housing and being rotatable to effect the rotatable movement of said brush members in counterrotation with respect to each other.

3. A device for cleaning golf clubs as set forth in claim 1, portion of the front and an adjacent side wall being cut away to form a corner slot that accommodates the shaft of the club to be cleaned, whereby the head of the club is properly directed between said brush members as the club shaft is placed within said corner slot.

4. A device as claimed in claim 1, said counterrotating shafts being rotated such that the rotating bristles, as they engage in overlapping relation thereof, effect a downwardly directed movement as they engage said club head disposed therebetween to effectively clean the grooves and the surfaces of said club head and to direct debris and dirt on said club head downwardly into said chamber.

5. A device as claimed in claim 1, means joined to said walls and spaced downwardly from the upper edges thereof for supporting said top member in a horizontal covering position over said chamber, thereby enclosing said chamber for protection against entry of debris therein.

6. A device as claimed in claim 1, said means for receiving the top member in a storage position including spaced support elements that are joined to the interior of one of said walls for supporting said top member in an upright storage position.

* * * * *